US006994482B2

(12) United States Patent
Terao et al.

(10) Patent No.: US 6,994,482 B2
(45) Date of Patent: Feb. 7, 2006

(54) WIRE DOT PRINTER HEAD AND WIRE DOT PRINTER

(75) Inventors: Yasunobu Terao, Shizuoka (JP); Takahiro Kawaguchi, Mishima (JP); Keishi Tsuchiya, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/940,362

(22) Filed: Sep. 14, 2004

(65) Prior Publication Data

US 2005/0214051 A1 Sep. 29, 2005

(30) Foreign Application Priority Data

Mar. 23, 2004 (JP) ..... 2004-084341

(51) Int. Cl.
*B41J 2/27* (2006.01)

(52) U.S. Cl. ..... 400/124.23; 400/124.11; 400/124.17; 400/124.2

(58) Field of Classification Search ..... 400/124.23, 400/124.11, 124.17, 124.2
See application file for complete search history.

(56) References Cited

U.S. PATENT DOCUMENTS

| | | | | |
|---|---|---|---|---|
| 4,537,520 | A * | 8/1985 | Ochiai et al. | 400/124.2 |
| 4,552,064 | A | 11/1985 | Sanders, Jr. et al. | |
| 4,767,227 | A * | 8/1988 | Mitsuishi et al. | 400/124.23 |
| 4,881,832 | A | 11/1989 | Mitsuishi et al. | |
| 4,988,223 | A | 1/1991 | Hilkenmeier et al. | |
| 4,993,854 | A | 2/1991 | Sato | |
| 5,074,687 | A | 12/1991 | Gugel | |
| 5,137,377 | A | 8/1992 | Ito et al. | |
| 5,205,659 | A | 4/1993 | Gugel et al. | |
| 5,290,112 | A | 3/1994 | Stempfle et al. | |
| 6,513,997 | B2 | 2/2003 | Terao | |
| 6,698,956 | B1 | 3/2004 | Terao et al. | |
| 6,776,545 | B1 | 8/2004 | Terao | |
| 6,805,503 | B1 | 10/2004 | Tsuchiya et al. | |
| 6,848,843 | B1 | 2/2005 | Kawaguchi | |
| 2004/0170461 | A1 | 9/2004 | Kawaguchi | |

FOREIGN PATENT DOCUMENTS

| | | | |
|---|---|---|---|
| JP | 02-011336 | A | 1/1990 |
| JP | 7-22994 | B2 | 2/1990 |
| JP | 3-007351 | A | 1/1991 |
| JP | 3-39256 | A | 2/1991 |
| JP | 03-191036 | A | 8/1991 |
| JP | 3-288660 | A | 12/1991 |
| JP | 4-002639 | A | 1/1992 |

(Continued)

OTHER PUBLICATIONS

U.S. Appl. No. 10/655,281, Inventor: Kawaguchi, T., filed: Sep. 3, 2003.

(Continued)

*Primary Examiner*—Minh Chau
(74) *Attorney, Agent, or Firm*—Frishauf, Holtz, Goodman & Chick, P.C.

(57) ABSTRACT

In order to restrain a flux loss for obtaining magnetic characteristic required for high-speed printing, a wire dot printer head has armature 4 having a pivot shaft serving as a center of a pivot and pivotably provided so as to oppose to plural cores formed on a yoke and an armature spacer provided on the yoke for forming a side magnetic path with respect to the armature, wherein, supposing that each of the saturated magnetic fluxes of the yoke, the armatures and the armature spacer is defined as A, B and C in this order, these components are formed to establish a relationship of A≧B≧C.

6 Claims, 4 Drawing Sheets

FOREIGN PATENT DOCUMENTS

| | | | |
|---|---|---|---|
| JP | 4-31061 | A | 2/1992 |
| JP | 04-105945 | A | 4/1992 |
| JP | 5-35288 | U | 5/1993 |
| JP | 6-218954 | A | 8/1994 |
| JP | 6-227000 | A | 8/1994 |
| JP | 07-125265 | A | 5/1995 |
| JP | 09-187972 | A | 7/1997 |
| JP | 09-314868 | A | 12/1997 |
| JP | 10-006537 | | 1/1998 |
| JP | 2833001 | B2 | 10/1998 |
| JP | 10-291330 | A | 11/1998 |
| JP | 2850673 | B2 | 11/1998 |
| JP | 11-78075 | A | 3/1999 |
| JP | 2944562 | A | 6/1999 |
| JP | 11-291524 | A | 10/1999 |
| JP | 2000-280497 | A | 10/2000 |
| JP | 2001-219586 | A | 8/2001 |

OTHER PUBLICATIONS

U.S. Appl. No. 10/655,894, Inventor: Kawaguchi, T., filed: Sep. 4, 2004.

U.S. Appl. No. 10/764,642, Inventor: Kawaguchi, T., filed: Jun. 26, 2004.

U.S. Appl. No. 10/940,361, Inventor: Kawaguchi, T. et al,. filed: Sep. 14, 2004.

U.S. Appl. No. 10/940,492, Inventor: Tsuchiya, K. et al,. filed: Sep. 14, 2004.

U.S. Appl. No. 10/940,432, Inventor: Kawaguchi, T. filed: Sep. 14, 2004.

U.S. Appl. No. 10/940,338, Inventor: Kawaguchi, T. et al,. filed: Sep. 14, 2004.

U.S. Appl. No. 11/073,118, Inventor: Kawaguchi et al., filed: Mar. 3, 2005.

U.S. Appl. No. 11/073,117, Inventor: Tsuchiya et al., filed: Mar. 3, 2005.

U.S. Appl. No. 11/073,092, Inventor: Kawaguchi et al., filed: Mar. 3, 2005.

U.S. Appl. No. 11/073,093, Inventor: Kawaguchi et al., filed: Mar. 3, 2005.

* cited by examiner

WIRE DOT PRINTER HEAD AND WIRE DOT PRINTER

CROSS REFERENCE TO RELATED APPLICATION

The present application is based on Japanese Priority Document 2004-84341 filed on Mar. 23, 2004, the content of which is incorporated herein by reference.

BACKGROUND OF THE INVENTION

1. Field of the Invention

The present invention relates to a wire dot printer head and a wire dot printer.

2. Description of the Prior Arts

There has been known a wire dot printer head wherein an armature with a printing wire connected thereto is pivoted between a printing position and a stand-by position, and when the armature is pivoted to the printing position, a tip of the wire is brought into collision with a printing medium such as a paper to effect printing. In a certain wire dot printer head of this type, there has been proposed a device wherein a magnetic flux is produced by a coil around the armature to be pivoted for forming a magnetic circuit that causes the armature to be attracted from a stand-by position to a printing position to effect printing (see Japanese Unexamined Patent Publication No. 191036/1991). In the patent document 1, a yoke or the like for forming a magnetic circuit is formed by sintering Fe particles or Co particles having a fine particle diameter to thereby improve magnetic characteristic such as a saturated flux density or the like.

However, the improvement in the saturated flux density of only a yoke does not mean the improvement in the magnetic flux characteristic of the whole wire dot printer head as disclosed in the Japanese Unexamined Patent Publication No. 191036/1991. Specifically, it is necessary to prevent a flux loss among the components forming the magnetic circuit such as a yoke, armature or the like. Even in case where an armature spacer for forming a side magnetic path to the armature is provided in addition to the yoke or armature, in particular, it is important to prevent the magnetic saturation among these components.

On the other hand, in case where a pivot shaft is inserted in a through hole in which the armature is pivotably mounted with the pivot shaft as a center, the inner face of the through hole comes in contact with the pivot shaft to thereby be scraped. Therefore, a certain surface hardening process is required to be provided on the inner face of the through hole. However, when the surface hardening process is provided also on the inner face of the through hole, the magnetic flux is hard to transmit through this section (flux loss), thereby deteriorating the magnetic characteristic.

As described above, the magnetic characteristic is deteriorated by the flux loss among the components or flux loss caused by the surface hardening process on the through hole, so that magnetic characteristic required for high-speed printing cannot be obtained. Therefore, high-speed printing cannot be executed. In particular, the armature is required to be pivoted 2500 times per second between the printing position and the stand-by position with a recent increased printing speed. Therefore, the deterioration in the magnetic characteristic becomes an important problem.

SUMMARY OF THE INVENTION

The present invention is accomplished in view of the above-mentioned circumstance, and aims to provide a wire dot printer head and a wire dot printer wherein a flux loss is restrained to thereby be capable of obtaining magnetic characteristic required for high-speed printing.

A wire dot printer head according to the present invention comprises plural armatures each having a through hole and a pivot shaft inserted into the through hole for serving as a center of a pivot, plural printing wires positioned parallel to the direction substantially perpendicular to the pivot shaft and provided respectively at the armatures, a yoke that has plural cores, each having a coil wound therearound, and holds the pivot shaft such that the armatures are attracted to the cores and an armature spacer that has plural guide sections forming a side magnetic path with respect to the armatures and mounted on the yoke for holding the pivot shaft with the yoke, wherein, supposing that each of the saturated magnetic fluxes of the yoke, the armatures and the armature spacer is defined as A, B and C in this order, these components are formed to establish a relationship of $A \geqq B \geqq C$.

A wire dot printer according to the present invention comprises a wire dot printer head comprising plural armatures each having a through hole and a pivot shaft inserted into the through hole for serving as a center of a pivot, plural printing wires positioned parallel to the direction substantially perpendicular to the pivot shaft and provided respectively at the armatures, a yoke that has plural cores, each having a coil wound therearound, and holds the pivot shaft such that the armatures are attracted to the cores and an armature spacer that has plural guide sections forming a side magnetic path with respect to the armatures and mounted on the yoke for holding the pivot shaft with the yoke, wherein, supposing that each of the saturated magnetic fluxes of the yoke, the armatures and the armature spacer is defined as A, B and C in this order, these components are formed to establish a relationship of $A \geqq B \geqq C$, a platen opposite to the wire dot printer head, a carriage that holds the wire dot printer head and reciprocates along the platen, a printing medium transporting section that transports a printing medium between the wire dot printer head and the platen and a unit that drive-controls the wire dot printer head, the carriage and the printing medium transporting section, to thereby effect printing based upon printing data.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Preferred embodiments for carrying out the present invention will be explained with reference to FIGS. 1 to 4.

[Wire Dot Printer Head]

Figure 1:
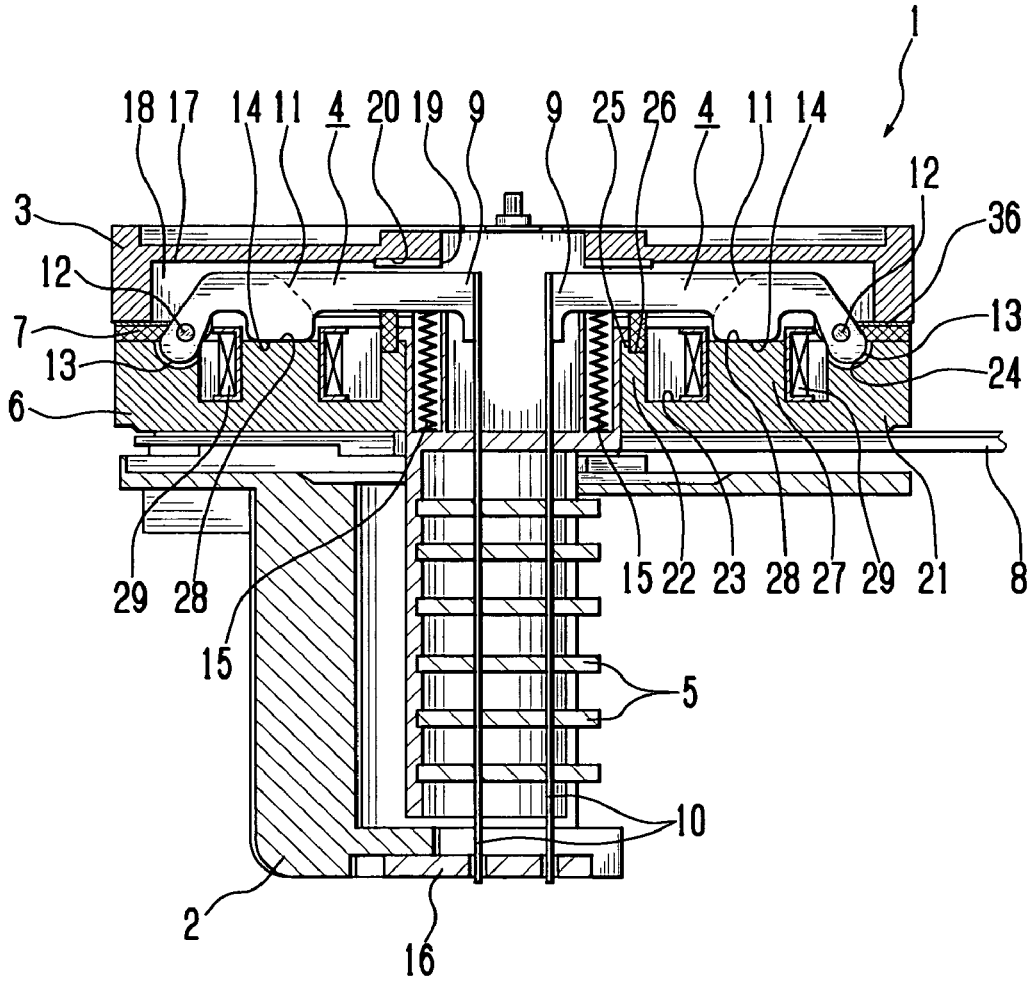
FIG. 1 is a front view in central vertical section of a wire dot printer head according to one embodiment of the present invention.
Figure 2:
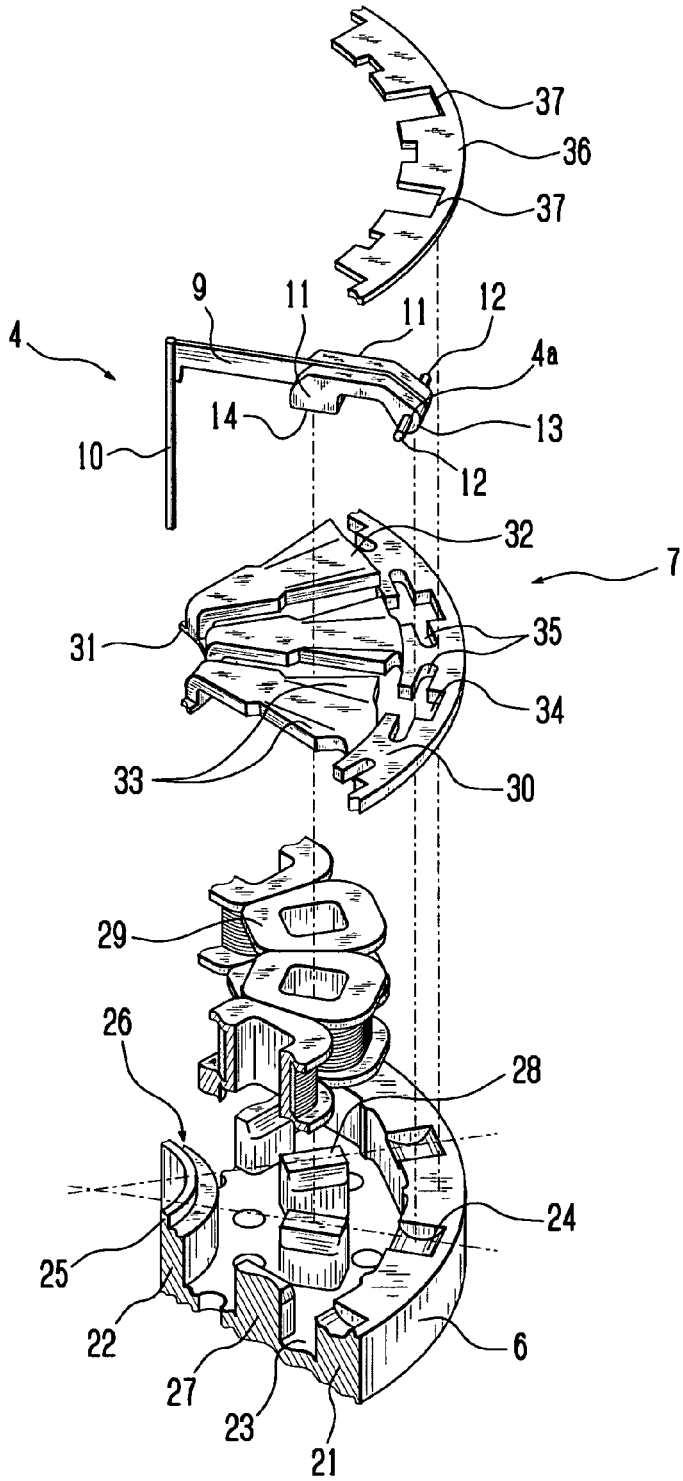
FIG. 2 is an exploded perspective view schematically showing a part of the wire dot printer head according to one embodiment of the present invention.
Figure 3:
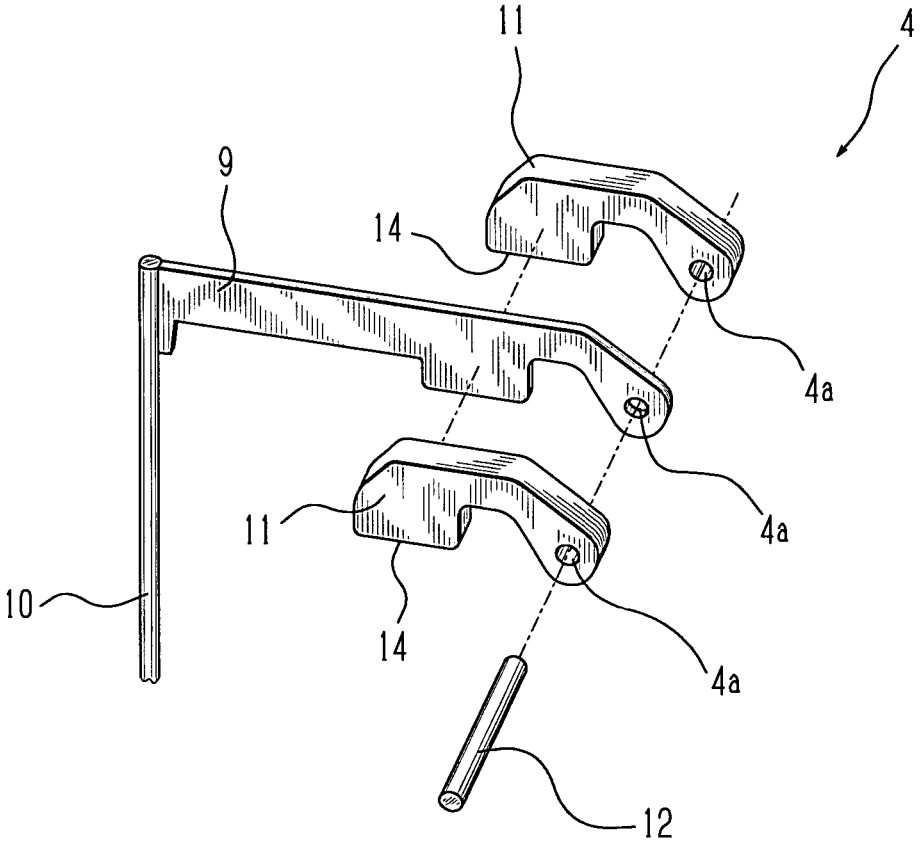
FIG. 3 is an exploded perspective view schematically showing an armature provided at the wire dot printer head according to one embodiment of the present invention.

Firstly, the entire construction of a wire dot printer head 1 will be explained with reference to FIGS. 1 to 3. FIG. 1 is a front view in central vertical section of a wire dot printer head 1 according to the embodiment, FIG. 2 is an exploded perspective view schematically showing a part of the wire dot printer head 1, and FIG. 3 is an exploded perspective view schematically showing an armature 4 provided at the wire dot printer head 1.

The wire dot printer head 1 has a front case 2 and a rear case 3 coupled together with a mounding screw, not shown. Disposed between the front case 2 and the rear case 3 are armatures 4, wire guides 5, yoke 6, armature spacer 7 and circuit board 8.

Each armature 4 has an arm 9 that is formed into a plate-like shape and supports a printing wire (hereinafter simply referred to as a wire) 10 at one end thereof in the lengthwise direction (in the direction in which the arm 9 extends), magnetic circuit forming members 11 formed at both side faces of the arm 9 in the widthwise direction for forming a magnetic circuit and a pivot shaft 12 that is rendered to be a center of the pivot. This pivot shaft 12 is mounted to be inserted into a through hole 4*a* formed at the armature 4 (see FIG. 3). The through hole 4*a* is formed at both the arm 9 and the magnetic circuit forming members 11. It should be noted that the pivot shaft 12 is pivotably mounted to the through hole 4*a*. Further, the wire 10 is soldered to one end of the arm 9. An arc-shaped section 13 is formed at the other end of the armature 4. An attracted face 14 is formed at each of the magnetic circuit forming members 11. This attracted face 14 is positioned at the central section of the armature 4 in the lengthwise direction.

Each of the magnetic circuit forming members 11 is made of, for example, permendule (PMD) that is a magnetic material excellent in magnetic characteristic. Further, the surface of the magnetic circuit forming member 11 (including the inner face of the through hole 4*a*) is subject to a surface hardening process. Examples of the surface hardening process include nitriding. Although only the magnetic circuit forming members 11 are made of permendule in this embodiment, the invention is not limited thereto. The whole armature 4 may be made of permendule, for example, so long as required strength is obtained.

Plural armatures 4 are radially arranged with respect to the center of the yoke 6. Each of the armatures 4 is held at the surface of the yoke 6 such that it is pivotable in the direction away from the yoke 6 with the pivot shaft 12 as a center, and it is urged by an urging member 15 such as a coil spring toward the direction away from the yoke 6. The urging member 15 is provided for executing the urging operation.

The wire guide 5 slidably guides the wire 10 for causing the tip of the wire 10 to strike against the predetermined position of a printing medium. Further, provided at the front case 2 is a tip guide 16 that aligns the tip of the wire 10 in a predetermined pattern and slidably guides the wire 10. It should be noted that the wire 10 moves to a position where the tip thereof strikes against the predetermined position, e.g., the printing medium such as a sheet or the like, with the pivot movement of the armature 4, when the armature 4 pivots to the printing position.

A cylindrical section 18 having a bottom face section 17 at the side of one end is provided at the rear case 3. A mounting recess section 20 to which a metallic annular armature stopper 19 is attached is formed at the central portion of the bottom face section 17. The mounting of the armature stopper 19 is performed by fitting the armature stopper 19 into the mounting recess 20. When the armature 4 pivots from the printing position by the urging member 15, the arm 9 as part of the armature 4 comes into contact with the armature stopper 19, thereby stopping the pivot movement of the armature 4. Therefore, the armature stopper 19 has a function for defining the stand-by position of the armature 4.

The circuit board 8 has a driving circuit for controlling the pivot movement of the armature 4 between the printing position and the stand-by position. The driving circuit of the circuit board 8 selectively pivots an optional armature 4 among plural armatures 4 during the printing operation.

The yoke 6 has a pair of cylindrical sections 21 and 22 that are concentrically mounted, each having a different diameter. The size in the shaft direction (in the vertical direction in FIG. 1, i.e., in the shaft direction of the yoke 6) of each cylindrical section 21 and 22 is set equal to each other. The cylindrical section 21 at the outer periphery side and the cylindrical section 22 at the inner periphery side are formed integral by a bottom face 23 formed so as to close one end in the shaft direction. The yoke 6 is held between the front case 2 and the rear case 3 in a state in which its open side opposite to the bottom face 23 is opposed to an open, opposite end side of the rear case 3.

Formed at the outer periphery-side cylindrical section 21 are plural recesses 24 that are equal in number of the armatures 4. Each of the recesses 24 has the inner peripheral face formed into a concave shape having a curvature radius approximately same as that of the outer peripheral face of the arc-shaped section 13 of the armature 4. The arc-shaped section 13 formed at one end of the armature 4 is slidably fitted into the recess 24.

A fitted section 25 having an annular shape is provided at the inner periphery-side cylindrical section 22. The fitted section 25 is integrally provided with the inner periphery-side cylindrical section 22 so as to be positioned concentric with the inner periphery-side cylindrical section 22. The outer diameter of the fitted section 25 is set smaller than the outer diameter of the inner periphery-side cylindrical section 22. Accordingly, a step section 26 is formed at the inner periphery-side cylindrical section 22 by the fitted section 25.

Provided integral with the bottom face 23 are plural cores 27 annually arranged between the outer periphery-side cylindrical section 21 and the inner periphery-side cylindrical section 22. The size of each core 27 in the shaft direction of the yoke 6 is set equal to the size of each cylindrical section 21 and 22 in the shaft direction of the yoke 6.

A pole face 28 is formed at one end of each core 27 in the shaft direction of the yoke 6. The pole face 28 of the core 27 is formed so as to oppose to the attracted face 14 of the magnetic circuit forming members 11 provided at the armature 4. Moreover, a coil 29 is wound around the outer periphery of each core 27. Specifically, the yoke 6 has plural cores 27 annually arranged, each core having the coil 29 wound therearound. Although the winding directions of all coils are set equal to one another in this embodiment, the invention is not limited thereto. For example, coils having different winding directions may be selectively arranged.

The yoke 6 described above is formed by, for example, a Lost Wax method or MIM (Metal Injection Molding) method with the use of permendule (PMD), that is a magnetic material excellent in magnetic characteristic, as a material. A surface hardening process is provided on the surface of the yoke 6. A nitriding is used as the surface hardening process, for example.

The armature spacer 7 has a pair of ring-shaped members 30 and 31 having diameters approximately equal to the diameters of the cylindrical sections 21 and 22 of the yoke 6 and plural guide members 32 radially bridged between the ring-shaped members 30 and 31 so as to be positioned between the armatures 4. These guide members 32 form a side magnetic path with respect to the armature 4. The outer periphery-side ring-shaped member 30 and the inner periphery-side ring-shaped member 31 are concentrically provided. The outer periphery-side ring-shaped member 30, inner periphery-side ring-shaped member 31 and the guide member 32 are integrally formed. The armature spacer 7 having the above-mentioned construction is made of, for example, permendule (PMD) that is a magnetic material excellent in magnetic characteristic. A surface hardening process is provided on the surface of the armature spacer 7. A nitriding is used as the surface hardening process, for example.

When the armature spacer 7 is disposed on the yoke 6, the outer periphery-side ring-shaped member 30 and the inner periphery-side ring-shaped member 31 come in contact with the cylindrical sections 21 and 22 of the yoke 6, whereby the inner periphery-side ring-shaped member 31 is fitted to the fitted section 25. It should be noted that the inner diameter of the inner periphery-side ring-shaped member 31 is set equal to or slightly greater than the outer diameter of the fitted section 25.

Each guide member 32 has a side yoke section 33 extending substantially radially of the ring-shaped members 30 and 31 toward the direction away from the pole face 28 of the core 27 and in the oblique direction. This side yoke section 33 has a blade-like shape that is wider toward the outer periphery-side ring-shaped member 30 from the inner periphery-side ring-shaped member 31.

Since the armature spacer 7 has plural guide members 32 bridged between a pair of ring-shaped members 30 and 31, slit-like guide grooves 34 are ensured that are open along the radius direction of the ring-shaped members 30 and 31. Each guide groove 34 is formed to have a width such that the side yoke section 33 comes close to the associated magnetic circuit forming member 11 to such an extent that it does not obstruct the pivot movement of the armature 4.

Further, the guide groove 34 communicates with the outer periphery-side ring-shaped member 30. Formed at the guide groove 34 at the outer periphery-side ring-shaped member 31 is a bearing groove 35 that is a cut-out section open contiguously to the guide groove 34 at the position of both side faces of the guide groove 34 along the outer diameter direction of the ring-shaped member 30. The pivot shaft 12 of the armature 4 is fitted into this bearing groove 35. Specifically, the pivot shaft 12 of the armature 4 is held by the yoke 6 and the armature spacer 7 such that the armature 4 opposes to the core 27.

A pressing member 36 for pressing the pivot shaft 12 of each of the plural armatures 4 fitted into the bearing groove 35 is mounted on the armature spacer 7. The pressing member 36 is a plate-like member for pressing the pivot shaft 12 of each of the plural armatures 4 by coupling the front case 2 and the rear case 3 with a mounting screw. This pressing member 36 is annually formed so as not to hinder the pivot movement of the armature 4. The pressing member 36 has plural groove sections 37 having a width approximately same as the width of the armature 4 and respectively extending toward its radius direction. A surface hardening process is provided on the surface of the pressing member 36. A nitriding is used as the surface hardening process, for example.

The diameter of the pivot shaft 12 of the armature 4 is about 0.90 mm and the thickness of the armature spacer 7 composing the bearing groove 35 is about 0.80 mm. Therefore, when the pivot shaft 12 of the armature 4 is fitted into the bearing groove 35, the pivot shaft 12 protrudes from the bearing groove 35 by about 0.10 mm to be in contact with the pressing member 36, thereby providing a secure support.

Supposing that each of the saturated magnetic fluxes of the yoke 6, the magnetic circuit forming members 11 of the armature 4 and the armature spacer 7 is defined as A, B and C in this order, these components are disposed so as to establish the relationship of $A \geqq B \geqq C$. Specifically, supposing that each of the saturated magnetic flux densities of the yoke 6, the magnetic circuit forming members 11 of the armature 4 and the armature spacer 7 is defined as A', B' and C' in this order, these components are disposed so as to establish the relationship of $A' \geqq B' \geqq C'$. As described above, the yoke 6, the magnetic circuit forming members 11 of the armature 4 and the armature spacer 7 are formed by using permendule (PMD) as a material, wherein the saturated magnetic flux densities of these are made equal to one another in this embodiment ($A'=B'=C'$). The saturated magnetic flux density of the permendule is about 0.20 T (tesla). This does not permit the magnetic saturation to occur in the yoke 6, magnetic circuit forming members 11 of the armature 4 and the armature spacer 7, with the result that the magnetic characteristic required for high-speed printing can be obtained.

Although the yoke 6, the magnetic circuit forming members 11 of the armature 4 and the armature spacer 7 are formed by using permendule (PMD) as a material, wherein the saturated magnetic flux densities of these establish the relationship of $A'=B'=C$, the invention is not limited thereto. For example, the yoke 6 and the magnetic circuit forming members 11 of the armature 4 may be formed by using the permendule as a material and the armature spacer 7 may be formed by using a silicon iron as a material, wherein the saturated magnetic flux densities of these may establish the relationship of $A'=B'>C$. The saturated magnetic flux density of the silicon iron is about 0.18 T. Further, for example, the yoke 6 may be formed by using the permendule as a material, the magnetic circuit forming members 11 of the armature 4 may be formed by using silicon iron as a material and the armature spacer 7 may be formed by using pure iron, wherein the saturated magnetic flux densities of these may establish the relationship of $A'>B'>C$. The saturated magnetic flux density of the pure iron is about 0.10 T. Even the relationship of the saturated magnetic flux density as described above does not permit the magnetic saturation to occur in the yoke 6, magnetic circuit forming members 11 of the armature 4 and the armature spacer 7, with the result that a magnetic characteristic required for high-speed printing can be obtained.

Moreover, it is desirable that the saturated magnetic flux density B' of the armature 4 is not less than 0.15 T. The saturated magnetic flux density B' of the armature 4 of not less than 0.15 T can surely provide magnetic characteristic required for high-speed printing.

[Wire Dot Printer]

Figure 4:
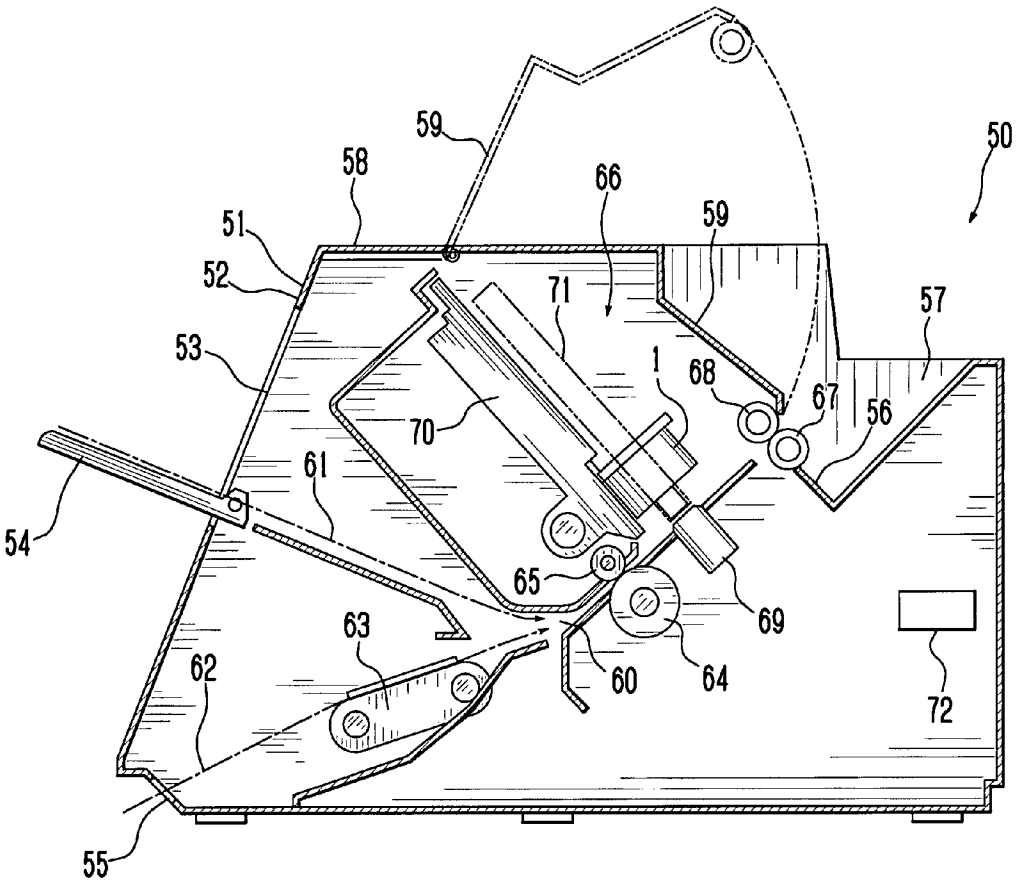
FIG. 4 is a longitudinal side view schematically showing a wire dot printer according to one embodiment of the present invention.

Subsequently explained with reference to FIG. 4 is a wire dot printer 50 provided with the wire dot printer head 1 described above. FIG. 4 is a longitudinal side view schematically showing the wire dot printer 50 according to the embodiment of the present invention.

The wire dot printer 50 has a housing case 51. An opening section 53 is formed at the front face 52 of the housing case 51. A manual tray 54 is mounted at the opening section 53 so as to be able to be opened and closed. Further, a paper feed port 55 is provided at the lower section of the front face 52 of the housing case 51, while a discharge tray 57 is provided at the back face side 56. Moreover, an open/close cover 59 is pivotably provided at the top face 58 of the housing case 51. The opened open/close cover 59 is shown by a virtual line in FIG. 4.

A sheet transporting path 60 that is a printing medium transporting path is provided in the housing case 51. The upstream side in the sheet transporting direction of the sheet transporting path 60 communicates with a paper feed path 61 arranged on the extended face of the opened manual tray 54 and a paper feed path 62 communicating with the paper feed port 55. The downstream side in the sheet transporting direction of the sheet transporting path 60 communicates with the discharge tray 57. A tractor 63 for transporting a sheet is provided in the sheet transporting path 62.

In the sheet transporting path 60, a transporting roller 64 and a pressing roller 65 are arranged so as to be opposite to each other, wherein the pressing roller 65 comes in pressed contact with the transporting roller 64. The transporting roller 64 and the pressing roller 65 transport a sheet that is a printing medium, and compose a sheet transporting section that is a printing medium transporting section. Further, disposed in the sheet transporting path 60 is a printer section 66 that performs a printing operation for the transported sheet. A discharge roller 67 is disposed at the inlet of the discharge tray 57. A pressing roller 68 that comes in pressed contact with the discharge roller 67 is pivotably supported at the side of a free end of the open/close cover 59.

The printer section 66 is composed of a platen 69 arranged in the sheet transporting path 60, a carriage 70 that can reciprocate along this platen 69 in the direction perpendicular to the sheet transporting path 60, the above-mentioned wire dot printer head 1 mounted on the carriage 70 and an ink ribbon cassette 71. It should be noted that the ink ribbon cassette 71 is removably mounted.

The carriage 70 is driven by a motor, not shown, to be reciprocated along the platen 69. The wire dot printer head 1 reciprocates in the main scanning direction with the reciprocating movement of the carriage 70 along the platen 69. Therefore, a head driving mechanism can be realized by the carriage 70 or motor in this embodiment. Further, the wire dot printer 50 has incorporated therein a driving control section 72 for controlling each section in the housing case 51. This driving control section 72 drive-controls each section of the printer section 66, tractor 63 and motor.

In this construction, when a single sheet is used as a sheet, it is fed from the manual tray 54. On the other hand, when plural sheets are continuously used, they are fed from the sheet feed port 55. Either sheet, not shown, is transported by the transporting roller 64, printed by the wire dot printer head 1 and discharged onto the discharge tray 57 by the discharge roller 67.

The printing is performed as follows. Specifically, the coil 29 is selectively excited in the wire dot printer head 1, whereby the armature 4 is attracted by the pole face 28 of the core 27 to be pivoted about the pivot shaft 12, resulting in that the wire 10 is pressed toward the sheet on the platen 69 via the ink ribbon, not shown. When the coil 29 is de-energized, the armature 4 returns under the urging force of the urging member 15 and stops at the stand-by position by the armature stopper 19. Although a sheet is used here as the printing medium, the invention is not limited thereto. For example, a pressure-sensitive color-developing paper can be used in which the color development occurs at the pressurized section. In case where the pressure-sensitive color-developing paper is used as the printing medium, the color development occurs at the section pressurized by the pressure of the wire 10 provided at the wire dot printer head 1, to thereby execute the printing.

Upon performing the printing operation by the wire dot printer 50, a coil 20 is selectively energized based upon the printing data by the control of the driving control section 72. Then, a magnetic circuit is formed among the core 27 on which the selected coil 29 is mounted, the magnetic circuit forming members 11 of the armature 4 opposed to the core 27, a pair of side yoke sections 33 opposed to the magnetic circuit forming members 11, guide members 32, the outer- and inner-periphery side cylindrical portions 21, 22 of the yoke 6, the bottom face 23 and again the core 27.

The formation of this magnetic circuit generates attraction force that attracts the magnetic circuit forming members 11 to the pole face 28 of the core 27 between the attracted face 14 of the magnetic circuit forming member 11 and the pole face 28 of the core 27. This attraction force allows the armature 4 to pivot about the pivot shaft 12 in the direction in which the attracted face 14 of the magnetic circuit forming member 11 is attracted to the pole face 28 of the core 27. It should be noted that the position where the attracted face 14 of the magnetic circuit forming member 11 of the armature 4 comes in contact with the pole face 28 of the core 27 is defined as the printing position in this embodiment.

As a result of the pivotal movement of the armature 4 to the printing position, the tip of the wire 10 projects to the side of the sheet. Since the ink ribbon is interposed between the wire dot printer head 1 and the sheet at this time, the pressure from the wire 10 is transmitted to the sheet via the ink ribbon and the ink from the ink ribbon is transferred onto the sheet, thereby carrying out the printing.

When the coil 29 is de-energized, the magnetism so far developed becomes extinct, so that the magnetic circuit also vanishes. Consequently, the attractive force for attracting the magnetic circuit forming member 11 to the pole face 28 of the core 27 disappears, so that the armature 4 is urged away from the yoke 6 with an urging force of the urging member 15 and pivots about the pivot shaft 12 toward the stand-by position. The armature 4 pivots toward the stand-by position until its arm 9 comes into contact with the armature stopper 19, whereupon the armature is stopped at the stand-by position.

The printing operation as described above is performed at high speed (for example, the printing speed of 2500 times per second). In this case, the armature 4 pivots between the printing position and the stand-by position with 2500 times per second. This high-speed printing can be realized by forming the yoke 6, magnetic circuit forming members 11 of the armature 4 and the armature spacer 7 to have saturated magnetic flux of the same level. Specifically, the yoke 6, the magnetic circuit forming members 11 of the armature 4 and the armature spacer 7 are made of permendule, whereby the saturated magnetic fluxes of these become the same level. Therefore, the magnetic flux loss does not occur among these components, with the result that magnetic characteristic required for the high-speed printing can be obtained. Consequently, high-speed printing can be realized.

Further, a surface hardening process is provided on the magnetic circuit forming members 11 of the armature 4.

Since the magnetic circuit forming members 11 are made of permendule, the hardening process is not provided up to the deep position (core) from its surface, that means the surface hardening process is provided only on an extremely thin section on the surface. This is because the member formed of a material having great saturated magnetic flux density such as permendule or the like has an advantage that the hardening process is not provided up to the deep position (core) from its surface. Accordingly, forming the magnetic circuit forming members 11 of the armature 4 by permendule prevents that the magnetic flux is hard to transmit through the magnetic circuit forming members 11, thus being capable of restraining the magnetic flux loss around the through hole 4*a* in particular.

Moreover, the saturated magnetic flux density B' of the armature 4 is not less than 0.15 T in this embodiment, thereby being capable of surely obtaining magnetic characteristic required for high-speed printing. Particularly, the yoke 6, armature 4 and armature spacer 7 are made of permendule, so that each of the saturated magnetic flux density of these components becomes approximately 0.20 T. Consequently, magnetic characteristic required for high-speed printing can surely be obtained.

Additionally, the wire dot printer 50 in this embodiment is provided with the above-mentioned wire dot printer head 1, platen 69 opposite to the wire dot printer head 1, carriage 70 that holds the wire dot printer head 1 and reciprocates along the platen 69 and transporting roller 64 and the pressing roller 65 serving as the printing medium transporting section for transporting a printing medium between the wire dot printer head 1 and the platen 69, wherein the wire dot printer head 1, carriage 70, transporting roller 64 and the pressing roller 65 are drive-controlled to effect printing based upon printing data. Therefore, a magnetic flux loss can be restrained, thereby being capable of obtaining magnetic characteristic required for high-speed printing. As a result, high-speed printing can be realized.

Obviously, numerous modifications and variations of the present invention are possible in light of the above teachings. It is therefore to be understood that within the scope of the appended claims, the invention may be practiced otherwise than as specifically described herein.

What is claimed is:

1. A wire dot printer head, comprising:

plural armatures each having a through hole and a pivot shaft inserted into the through hole for serving as a center of a pivot;

plural printing wires positioned parallel to the direction substantially perpendicular to the pivot shaft and provided respectively at the armatures;

a yoke that has plural cores, each having a coil wound therearound, and holds the pivot shaft such that the armatures are attracted to the cores; and an armature spacer that has plural guide sections forming a side magnetic path with respect to the armatures and mounted on the yoke for holding the pivot shaft with the yoke;

wherein, supposing that each of the saturated magnetic fluxes of the yoke, the armatures and the armature spacer is defined as A, B and C in this order, these components are formed to establish a relationship of $A \geqq B \geqq C$.

2. A wire dot printer head according to claim 1, wherein the saturated flux density of the armatures is not less than 0.15 T.

3. A wire dot printer head according to claim 1 or 2, wherein the yoke, the armatures and the armature spacer are made of permendule.

4. A wire dot printer comprising:

a wire dot printer head comprising:

plural armatures each having a through hole and a pivot shaft inserted into the through hole for serving as a center of a pivot;

plural printing wires positioned parallel to the direction substantially perpendicular to the pivot shaft and provided respectively at the armatures;

a yoke that has plural cores, each having a coil wound therearound, and holds the pivot shaft such that the armatures are attracted to the cores; and an armature spacer that has plural guide sections forming a side magnetic path with respect to the armatures and mounted on the yoke for holding the pivot shaft with the yoke;

wherein, supposing that each of the saturated magnetic fluxes of the yoke, the armatures and the armature spacer is defined as A, B and C in this order, these components are formed to establish a relationship of $A \geqq B \geqq C$;

a platen opposite to the wire dot printer head;

a carriage that holds the wire dot printer head and reciprocates along the platen;

a printing medium transporting section that transports a printing medium between the wire dot printer head and the platen; and a unit that drive-controls the wire dot printer head, the carriage and the printing medium transporting section, to thereby effect printing based upon printing data.

5. A wire dot printer according to claim 4, wherein the saturated flux density of the armatures is not less than 0.15 T.

6. A wire dot printer according to claim 4 or 5, wherein the yoke, the armatures and the armature spacer are made of permendule.

* * * * *